United States Patent [19]

Stamper et al.

[11] Patent Number: 4,827,686

[45] Date of Patent: May 9, 1989

[54] COATED ROOFING MEMBRANE

[75] Inventors: Richard W. Stamper, Lambertville, Mich.; Robert C. Hultz, Toledo, Ohio

[73] Assignee: GenCorp Inc., Akron, Ohio

[21] Appl. No.: 93,675

[22] Filed: Sep. 8, 1987

[51] Int. Cl.[4] ..... E04B 7/00

[52] U.S. Cl. ..... 52/408; 428/286; 428/413; 428/519; 428/521

[58] Field of Search ..... 428/291, 286, 413, 519, 428/521, 523; 427/186; 52/408, 409, 94

[56] References Cited

U.S. PATENT DOCUMENTS

| | | | |
|---|---|---|---|
| 3,252,851 | 5/1966 | Benson | 428/291 |
| 4,424,253 | 1/1984 | Anderson | 428/521 |
| 4,435,466 | 3/1984 | Kuhnel et al. | 428/521 |
| 4,565,732 | 1/1986 | Stamper et al. | 52/408 |
| 4,588,637 | 5/1986 | Chiu | 428/521 |
| 4,589,804 | 5/1986 | Paeglis et al. | 428/143 |
| 4,666,785 | 5/1987 | Crepeau | 428/521 |

*Primary Examiner*—Paul J. Thibodeau

[57] ABSTRACT

An uncured or cured rubbery roofing membrane of EPDM or polychloprene rubber has a cured, flexible epoxy resin coating which is flexible and adherent to the roofing membrane. The coating, also, may be pigmented.

20 Claims, No Drawings

COATED ROOFING MEMBRANE

This invention relates to roofing membranes.

An object of this invention is to provide a new roofing membrane.

This and other objects and advantages of the present invention will become more apparent to those skilled in the art from the following detailed description and examples.

SUMMARY OF THE INVENTION

Chlorosulfonated polyethylene coatings have traditionally been used on EPDM polymers (ethylene-propylene-non-conjugated diene terpolymers) and polychloroprene roofing membranes for aesthetic reasons. These membranes are typically black. If another color was desired, the membrane was painted with a pigmented chlorosulfonated polyethylene solution. A problem with this is that the chlorosulfonated polyethylene coatings stain when painted over some polychloroprene membranes. Another problem is that the chlorosulfonated coating erodes away and must be renewed every few years.

These problems have been resolved by the use of flexible, cured, pigmented and adherent epoxy resin coatings on polychloroprene or EPDM membranes. One special aspect is that the epoxide coating can be used over staining polychloroprenes without becoming stained. Also, the epoxide coating is more durable than the chlorosulfonated polyethylene coating.

DISCUSSION OF DETAILS AND PREFERRED EMBODIMENTS

Epoxy resins are well known. They are obtained from the diglycidyl ether of bisphenol (A) and its homologs, glycidyl ethers of glycerol, glycidyl ethers of bisphenol F, glycidyl ethers of long-chain bisphenols, epoxylated novolaks, aliphatic epoxides such as the diglycidyl ester of linoleic dimer acid (preferred) and the like. They have epoxide equivalents of from about 200 to 600 and should be spreadable (liquid or semi-liquid).

The epoxy resins may be cured with primary aliphatic amines such as diethylene triamine, diethylamine, propylamine, triethylene tetramine (preferred), ethylene diamine, triethylamine and metaphenylene diamine, oxalic acid, phthalic anhydride, hexahydrophthalic anhydride, maleic anhydride and so forth.

Most conventional paint pigments can be used with epoxy coating formulations, although a few should be avoided. Zinc fillers tend to affect the curing mechanisms, and alkaline and metallic pigments should be avoided if acidic curing agents are employed. Suitable materials are cadmium sulfide, phthlocyanine blue and green, titanium dioxide (preferred), chromic oxide, calcium carbonate, silica, toluidine red, etc. Metal primers based on red iron oxide, etc., likewise may be used with success.

The resin may be pigmented in the normal manner by the use of ball or roll mills.

As in the case of other coating formulations, gloss may be adjusted by varying the binder/pigment ratio as well as by the selection of curing agents.

Although the specific filler will dictate the effect, the general effect of chemically inert pigments may be to increase the cure time. With room-temperature curing agents, cure times are about doubled. Flow-control agents may be used to reduce surface tension and improve leveling. Examples are polyvinyl butyral, silicones and ureas. Additionally, silicates may be used to thicken the material so that it may be used on vertical surfaces. The flow-control agents are used in small amounts, on the order of 1 to 3 percent. The epoxy coating composition can be applied to the rubbery substrate using any conventional coating technique (brush, print roller, dip or spray). The thickness of the coating can range from about 0.002" to 0.020". Preferably, the thickness of the coating is from about 0.007" to 0.010". The epoxy coating is generally applied to the weather side of the roofing membrane although it can be applied to both sides. Also, the coating is usually painted on the roofing membrane after the roofing membrane has been installed on a roof.

Epoxy resins are known as shown by Lee and Neville, "Epoxy Resins," McGraw-Hill Book Company, Inc., New York, 1957; Lee and Neville, "Handbook of Epoxy Resins," McGraw-Hill Book Company, Inc., New York, 1967 and Bruins, "Epoxy Resin Technology," Interscience Publishers, a division of the John Wiley & Sons, New York, 1968.

Ethylene-propylene-non-conjugated diene rubbery terpolymers (EPDMs) are well-known. They are made by the copolymerization of ethylene, propylene and a non-conjugated diene such as 1,4-hexadiene (preferred), ethylidene norbornene or dicyclopentadiene. They may be crystalline or non-crystalline. Their relative unsaturation can vary from about 0.7 to 4.5. The mole % of ethylene can vary from about 62 to 85, and the raw (uncured and uncompounded) Mooney viscosity (ML 1+8 at 250° F.) can vary from about 14 to 84. These EPDM polmers are compounded with reinforcing blacks (preferred are furnace blacks). They also, may contain antioxidants, fillers like clays and rubber extender oils such as petroleum oils. Rubbery or elastomeric EPDM terpolymers, methods for making them and methods for curing them are known as shown by "Rubber Chemistry and Technology," Volume 45, No. 1, March, 1972, Division of Rubber Chemistry, Inc., American Chemical Society, pages 709 to 881; "Rubber Technology," 2nd ED., Morton, Van Nostrand Reinhold Company, New York, 1973, Chapter 9; "Polymer Chemistry of Synthetic Elastomers," Part II, High Polymers Series, Vol. 23, John Wiley & Sons Inc. New York, 1969, Chapter 7; "Encyclopedia Of Polymer Science and Technology," Interscience Publishers a division of John Wiley & Sons, Inc., New York, Vol. 6 (1967) pages 367–8 and Vol. 5 (1966) page 414 and "Synthetic Rubber Manual," International Institute of Synthetic Rubber Producers, Inc., 10th Ed., 1986.

If the EPDMs are to be cured, they can be cured using an accelerated sulfur type cure system. See "The Vanderbilt Rubber Handbook," R. T. Vanderbilt Company, Inc., Norwalk, Ct., 1978.

Polychloroprenes (Neoprene, polymerized 2-chloro-1,3-butadiene) are well known. They have a nominal Mooney viscosity ML 1+4 at 100° C. of from about 44 to 115 and a specific gravity of from about 1.23 to 1.25. Their crystallization rate can vary from very low to very high. They may be cured using plasticizers, if desired, stearic acid, metallic oxides, accelerators, ethylene thioureas, antioxidants, carbon black and so forth. See "Synthetic Rubber," Whitby et al, John Wiley & Sons, Inc., New York, 1954; "The Synthetic Rubber Manual," supra; and "The Vanderbilt Rubber Handbook," supra.

Usually roofing membranes are manufactured in two layers (calendered together) to avoid the possibility of pinholes. Each membrane provides a layer of from about 10 to 30 mils thick. Roofing membrane also includes flashing.

If the roofing membranes are to be reinforced, each rubber layer of the roofing membrane can be calendered on each side of the reinforcing membrane.

The reinforcing intermediate layer can be a woven or non woven fabric. The fabric can be of open or closed weave. The fibers, yarns or cords of the fabric can be natural or synthetic organic fibers or mixtures thereof. Additionally, the yarns may vary from one type to another type. Examples of such yarns are those from silk, cotton, rayon, wool, hair, nylon, aramid, acrylics ("Acrilan"), polyester (preferred), polyvinylchloride, vinyl chloride-vinyl acetate copolymers, polyurethanes rayon, polyacrylonitriles, vinyl chloride or vinylidene chloride copolymerized with acrylonitrile, polyvinylidene chloride, polypropylene fibers and the like. Glass fibers may be blended or woven with the natural and/or synthetic organic fibers. These fibers or yarns can contain fire retardants, antistatic agents, bacteriostats, antidegradants, dyes, pigments, cord adhesives and so forth.

In preparing the roofing membrane all of the ingredients are mixed together on a break-down mill or in a Banbury mixer at a temperature of from about 250° F. to 300° F. and then sheeted out on a plastic mill. Alternatively the composition may be extruded. The resulting composition is then passed through a standard 4-roll calender, optionally with the reinforcing fabric layer, at a temperature of from about 270° F. to 320° F. to provide two layers of rubbery roofing membranes laminated together. If necessary, it is then cured in an autoclave.

The flexible laminate of this invention is used as a roofing layer or membrane on the roof of a building. The flexible laminate is placed on the surface of wood, concrete, insulation or other structural material or member of the roof of a building with the layer containing the epoxide coating exposed to the elements or weather.

The following examples will serve to illustrate the present invention with more particularity to those skilled in the art. In the example, the parts are parts by weight unless otherwise indicated.

EXAMPLE 1

The following coating composition was prepared:

| Ingredients | Parts By Weight |
|---|---|
| EPON 871 (1) | 35 |
| TETA (2) | 4 |
| $TiO_2$ | 10 |
| CAB-O-SIL (3) | 1 |

The composition was coated on an uncured EPDM roofing membrane and then oven dried for two days. The coating did not crack when the laminate was bent over.

EXAMPLE 2

The following coating composition was prepared:

| Ingredients | Parts By Weight |
|---|---|
| EP 266 (4) | 50 |
| Hardener (5) | 20 |
| $TiO_2$ | 15 |
| CAB-O-SIL | 1 |

The composition was coated on uncured EPDM roofing membrane and then oven dried for two days. The coating did not crack when the laminate was bent over.

EXAMPLE 3

The following coating composition was prepared:

| Ingredients | Parts by Weight |
|---|---|
| EPON 8132 (1) | 60.0 |
| $TiO_2$ | 36.0 |
| Pine Oil | 1.0 |
| CAB-O-SIL | 2.5 |
| EPON V-40 (6) | 50.0 |

The coating demonstrated super flexibility and adhesion with respect to the coatings of Examples 1 and 2 and is the preferred embodiment.

Notes For the Examples:

(1) Diglycidyl ester of linoleic dimer acid, epoxy equivalent weight of 390–470, viscosity centipoises at 25° C. of 400–900. Shell Chemical Company.

(2) Triethylene tetramine.

(3) Fumed colloidal silica. Cabot Corporation.

(4) Epoxy resin. Thermoset Company.

(5) Tertiary amine.

(6) Amine co-reactant. Shell Chemical Company.

What is claimed is:

1. A roofing membrane comprising at least two calendered layers of a cured or uncured compounded flixible rubber, each layer having a thickness of from about 10 to 30 mils, where the rubber is selected from the group consisting of an ethylene-propylene-non-conjugated diene terpolymer rubber and a polychloroprene rubber, said membrane having at least on its weather side an adherent, cured, pigmented non-staining, durable and flexible coating of from about 0.002" to 0.020" thick of an epoxide resin where the epoxy compound used to form the resin has an epoxide equivalent of from about 200 to 600 and is liquid or semi-liquid.

2. A roofing membrane according to claim 1 where the pigment is $TiO_2$.

3. A roofing membrane according to claim 2 where said rubber is an uncured ethylene-propylene-non-conjugated diene terpolymer.

4. A roofing membrane according to claim 2 where said rubber is an uncured polychloroprene.

5. A roofing membrane according to claim 2 where a reinforcing fabric layer is disposed between said calendered layers.

6. A building having a roof wherein the structural or insulation member of the roof contains a roofing membrane comprising at least two calendered layers of a cured or uncured compound flexible rubber, each layer having a thickness of from about 10 to 30 mils, where the rubber is selected from the group consisting of an ethylene-propylene-non-conjugated diene terpolymer rubber and a polychlorprene rubber, said membrane having at least on its weather side an adherent, cured, pigmented, non-staining, durable and flexible coating of from about 0.002" to 0.020" thick of an epoxide resin where the epoxy compound used to form the resin has an epoxide equivalent of from about 200 to 600.

7. A building according to claim 6 where the pigment is $TiO_2$.

8. A building according to claim 7 where said rubber is an uncured ethylene-propylene-non-conjugated diene terpolymer.

9. A building according to claim 7 wherein said rubber is an uncured polychloroprene.

10. A building according to claim 7 where a reinforcing fabric layer is disposed between said calendered layers.

11. The roofing membrane of claim 1 wherein said flexible coating is from about 0.007" to 0.010" thick.

12. The roofing membrane of claim 6 wherein said flexible coating is from about 0.007" to 0.10" thick.

13. An adherent flexible coating which is adhered to a flexible rubber substrate comprising; said rubber substrate selected from the group consisting of an ethylene-propylene, non-conjugated diene terpolymer rubber and a polychloroprene rubber, the coating being a cured, pigmented, durable and flexible epoxy resin, said epoxy resin being adhered to said rubber substrate and being non-stainable by said rubber substrate, wherein said epoxy resin has an epoxide equivalent of from about 200 to 600, and said coating having a thickness from about 0.002" to 0.020".

14. The coating compound of claim 13 wherein the rubber substrate is a roofing membrane.

15. The coating compound of claim 13 wherein the pigment is $TiO_2$.

16. The coating compound of claim 13 wherein the rubber substrate is comprised or one of more layers.

17. The coating compound of claim 13 wherein the rubber substrate is comprised of at least two layers of rubber and at least one reinforcing layer.

18. The coating compound of claim 14 wherein the pigment is $TiO_2$.

19. The coating compound of claim 14 wherein the rubber substrate is comprised of one or more layers.

20. The coating compound of claim 14 wherein the rubber substrate is comprised of at least two layers of rubber and at least one reinforcing layer.

* * * * *